United States Patent [19]

Parks

[11] Patent Number: 4,538,430

[45] Date of Patent: Sep. 3, 1985

[54] RING SIZING INSERT

[76] Inventor: Armond O. Parks, 430 Hawthorne Ave., Athens, Ga. 30606

[21] Appl. No.: 604,234

[22] Filed: Apr. 26, 1984

[51] Int. Cl.[3] ..... A44C 9/02
[52] U.S. Cl. ..... 63/15.6; 308/244
[58] Field of Search ..... 63/15.6; 308/244

[56] References Cited

U.S. PATENT DOCUMENTS

| | | | |
|---|---|---|---|
| 3,362,189 | 1/1968 | De Santo | 63/15.6 |
| 3,483,717 | 12/1969 | Mayer | 63/15.6 |
| 4,129,999 | 12/1978 | Shelton | 63/15.6 |

FOREIGN PATENT DOCUMENTS

| | | | |
|---|---|---|---|
| 805319 | 5/1951 | Fed. Rep. of Germany | 63/15.6 |
| 415925 | 7/1910 | France | 63/15.6 |
| 5525 | 5/1906 | United Kingdom | 63/15.6 |
| 193573 | 3/1923 | United Kingdom | 63/15.6 |

*Primary Examiner*—F. Barry Shay

[57] ABSTRACT

A ring sizing insert formed of clear thermoplastics is constructed to be initially flat and is provided with opposite end tapering curved jaws which are snapped into gripping engagement with a ring shank. When a ring wearer's finger is slipped into the ring with the insert installed thereon, the insert yields and assumes a shape conforming to the curvature of the finger while exerting a gentle spring action thereagainst to prevent rotation or other movements of the ring on the finger.

3 Claims, 6 Drawing Figures

FIG. 1
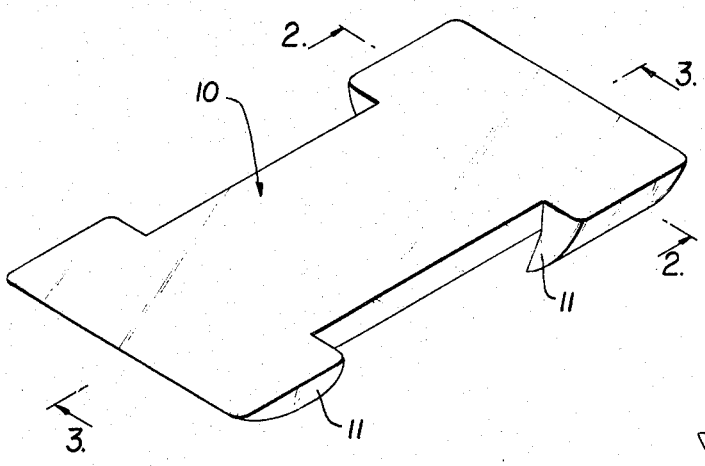
FIG. 2
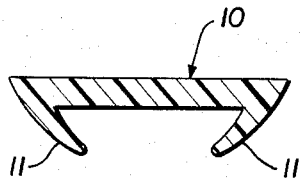
FIG. 3
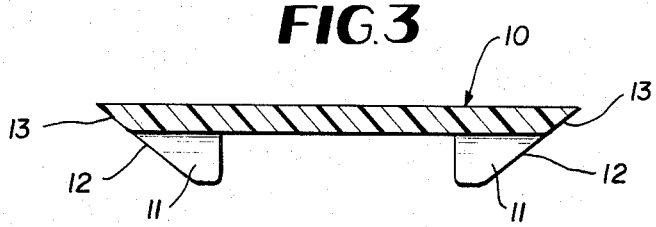
FIG. 4
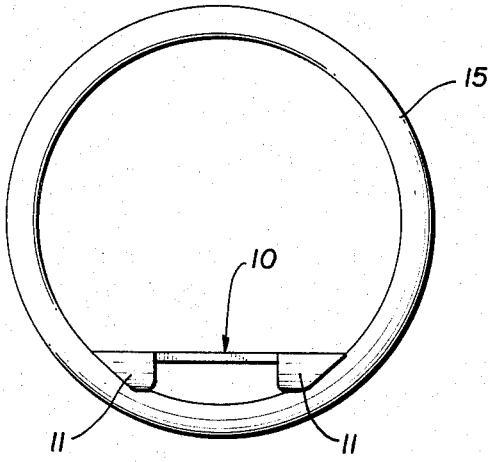
FIG. 5
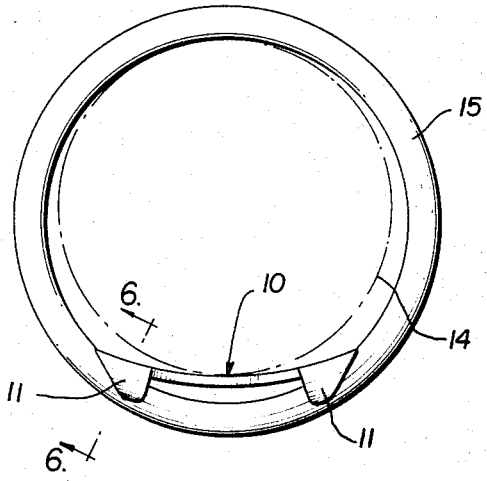
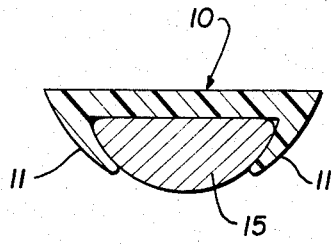
FIG. 6

RING SIZING INSERT

BACKGROUND OF THE INVENTION

Ring sizing attachments or inserts, sometimes called guards, are well known in the art in a variety of types. Traditionally, these devices are metallic and are attached to ring shanks by bending with a crimping tool or pliers. The prior art devices have tended to be uncomfortable in that they do not conform well to the varying shapes of fingers.

With the above in mind, it is the objective of this invention to provide a more comfortable and efficient sizing attachment for finger rings which will conform well to the varying contours of fingers while adequately gripping the ring shank so as to resist undesirable turning of the ring on the finger of the wearer.

In accomplishing the above objective, a ring sizing attachment or insert formed of a thermoplastic is provided. The device has an initially flat plate-like body portion equipped at opposite ends with curved and tapered ring shank gripping claws or jaws.

The device can be snapped onto any ring in a generally flat state and when a finger is inserted through the ring, the thermoplastic device will yield, conform to the shape of the finger, and exert a gentle spring force on the finger with a counter-force being transmitted to the ring. Body heat transmitted through the finger tends to slightly soften the thermoplastic material, rendering it more yielding and increasing its friction with the finger and ring shank.

Other features and advantages of the invention will become apparent during the course of the following detailed description.

BRIEF DESCRIPTION OF THE DRAWINGS

FIG. 1 is a perspective view of a ring sizing insert according to the invention in a relaxed state.

FIG. 2 is a transverse vertical section taken on line 2—2 of FIG. 1.

FIG. 3 is a longitudinal vertical section taken on line 3—3 of FIG. 1.

FIG. 4 is a side elevation of the ring sizing insert being applied to a ring.

FIG. 5 is a similar view showing the insert completely installed and being engaged by a finger of a ring wearer.

FIG. 6 is an enlarged cross section through the insert and ring taken on line 6—6 of FIG. 5.

DETAILED DESCRIPTION

Referring to the drawings in detail wherein like numerals designate like parts, a ring sizing attachment or insert 10 according to the invention is formed of a suitable thermoplastics material which is preferably clear to render the device inconspicuous. Prior to application to a ring, the insert is essentially flat or plate-like and possesses a uniform thickness throughout its length and width.

At its opposite ends, however, the insert 10 carries pairs of integral opposite side resilient claws 11 which are tapered toward their free ends, arcuate and convergent toward the center of the flat body portion of the insert (FIG. 2). The claws 11 extend beyond one face only of the insert, and its opposite face is smooth and unobstructed.

In addition to being tapered curved and convergent as viewed from the ends of the device, FIG. 2, the claws 11 are also tapering as viewed from the side, FIG. 3, in the manner of truncated triangles. The outer inclined edges 12 of the claws 11, FIG. 3, diverge toward the smooth flat face of the insert whose opposite end edges 13 are beveled on the same angles as the edges 12 of the claws.

The insert 10 while being relatively stiff is somewhat yielding and able to conform to the shape of a finger 14 of a wearer of a ring 15 on which the sizing insert 10 is installed.

Installation is accomplished by merely forcing or snapping the yielding claws 11 around the shank of the ring 15, which typically has a cross-sectional shape like that shown in FIG. 6. When thus applied to a ring, the pairs of claws 11 will grip the ring shank snugly while the body portion of the insert 10 remains generally flat so as to bridge across a sector portion of the ring prior to the insertion of a finger through the ring.

When the finger 14 is inserted, FIG. 5, the thermoplastics insert will yield and assume an arcuate configuration generally conforming to the curvature of the finger. This conformability of the insert 10 is enhanced by its thermoplastic nature, responding to body heat transmitted to it through the finger. When becoming warm due to body heat, the insert tends to soften slightly and better shapes itself to the finger and also to the ring shank. Its frictional resistance to sliding on the finger and ring shank also tends to increase due to warming and softening.

As a result of all of these factors, the sizing device according to the invention is more comfortable, more convenient to use and more efficient in preventing ring movement on the finger than are the prior art devices for this purpose.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ring sizing device formed of a thermoplastics material and being unitary, resilient, and shaped to fit along the inner periphery of a ring shank, said device comprising a plate-like body portion which is substantially flat when in a relaxed state and somewhat deformable under pressure from the finger, and pairs of curved tapering and convergent ring shank engaging claws secured to the opposite sides at opposite ends of the body portion and projecting beyond one face of the body portion to retain the device in position on a ring shank, the opposite face of the body portion being unobstructed and smooth.

2. A ring sizing device, said device being resilient, of a size and shape to lie along the inner periphery of a ring shank, formed of clear thermoplastics material and having a flat uniform thickness body portion of substantially rectangular form when the device is in a relaxed state, a pair of opposing arcuate convergent tapering claws at each end on the opposite sides of the body portion projecting beyond one surface only of the body portion and being yieldingly engageable with a ring shank to retain the device in position thereon, said body portion being adapted to yield and conform generally to the transverse curvature of the finger of the wearer of a ring on which the device is installed, whereby the conforming device can exert a yielding pressure against the finger to resist turning of the ring on the finger.

3. A ring sizing device as defined in claim 2, and said body portion being elongated circumferentially of a ring on which it is installed and having beveled end faces which substantially fit the curvature of the ring at opposite ends of the device.

* * * * *